US006450669B2

(12) United States Patent
Buss et al.

(10) Patent No.: US 6,450,669 B2
(45) Date of Patent: Sep. 17, 2002

(54) LIGHT STAND HAVING A FIXTURE HEIGHT ADJUSTMENT MECHANISM

(75) Inventors: Melvin H. Buss, Burlington; Michael T. Heath, Hinesburg, both of VT (US)

(73) Assignee: America's Gardening Resource, Inc., Burlington, VT (US)

( * ) Notice: Subject to any disclaimer, the term of this patent is extended or adjusted under 35 U.S.C. 154(b) by 0 days.

(21) Appl. No.: 09/738,605

(22) Filed: Dec. 15, 2000

Related U.S. Application Data

(60) Provisional application No. 60/171,124, filed on Dec. 16, 1999.

(51) Int. Cl.[7] ..... F21V 21/34

(52) U.S. Cl. ..... 362/285; 362/217; 362/418; 362/250

(58) Field of Search ..... 362/285, 286, 362/385, 386, 418, 430, 217, 431, 238, 250; 248/320, 332, 125.1, 125.2, 125.3

(56) References Cited

U.S. PATENT DOCUMENTS

| | | | | |
|---|---|---|---|---|
| 1,328,448 A | | 1/1920 | Pieper | |
| 1,633,344 A | | 6/1927 | Moran | |
| 1,662,568 A | | 3/1928 | Foell | |
| 2,833,505 A | | 5/1958 | Dulle | 248/320 |
| 3,583,743 A | | 6/1971 | Newell | 292/339 |
| 3,589,757 A | | 6/1971 | Mooney | 287/58 |
| 3,686,498 A | * | 8/1972 | Meyer | 362/238 |
| 3,763,368 A | | 10/1973 | Baggott | |
| 3,958,116 A | * | 5/1976 | Jones | 362/238 |
| 4,057,211 A | | 11/1977 | Moore | 248/332 |
| 4,316,238 A | | 2/1982 | Booty et al. | 362/147 |
| 4,348,717 A | * | 9/1982 | Thompson | 362/403 |
| 4,956,758 A | | 9/1990 | Aubrey et al. | 362/285 |
| 5,031,085 A | * | 7/1991 | Rustin | 362/401 |
| 5,641,223 A | | 6/1997 | Rustebakke | 362/122 |

OTHER PUBLICATIONS

Charley's Lighting—Fluorescent; http://www.charley-sgreenhouse.com/lght2/Fl.htm.

C–Fernweb Manual; http://cfern.bio.utk.edu/manual/lightstandcard01.html.

* cited by examiner

*Primary Examiner*—Thomas M. Sember
(74) *Attorney, Agent, or Firm*—Downs Rachlin Martin PLLC

(57) ABSTRACT

A light stand (10) having a pair of height adjustment mechanisms (14) which allows a user to selectively adjust the height of a light fixture (12) supported by the light stand on end at a time. The light stand includes a pair of spaced-apart vertical supports (16) and a horizontal member (56) extending between the supports and attached to the supports at opposite ends. Each height adjustment mechanism comprises an elongate flexible member (64) extending over a guide (60) attached to the inner horizontal member and securable to a securing device (62) attached to one of the vertical supports. The elongate flexible member is connected to the light fixture at one end (70), extends over the guide and is securable to the securing device. To change the height of one end of the light fixture, a user disengages one of the elongate flexible members from the corresponding securing devices, adjusts the length of the elongate flexible member played out from the guide and engages the elongate flexible member with securing device. If desired, the user repeats the forgoing steps with the height adjustment mechanism at the opposite end of the light fixture.

18 Claims, 3 Drawing Sheets

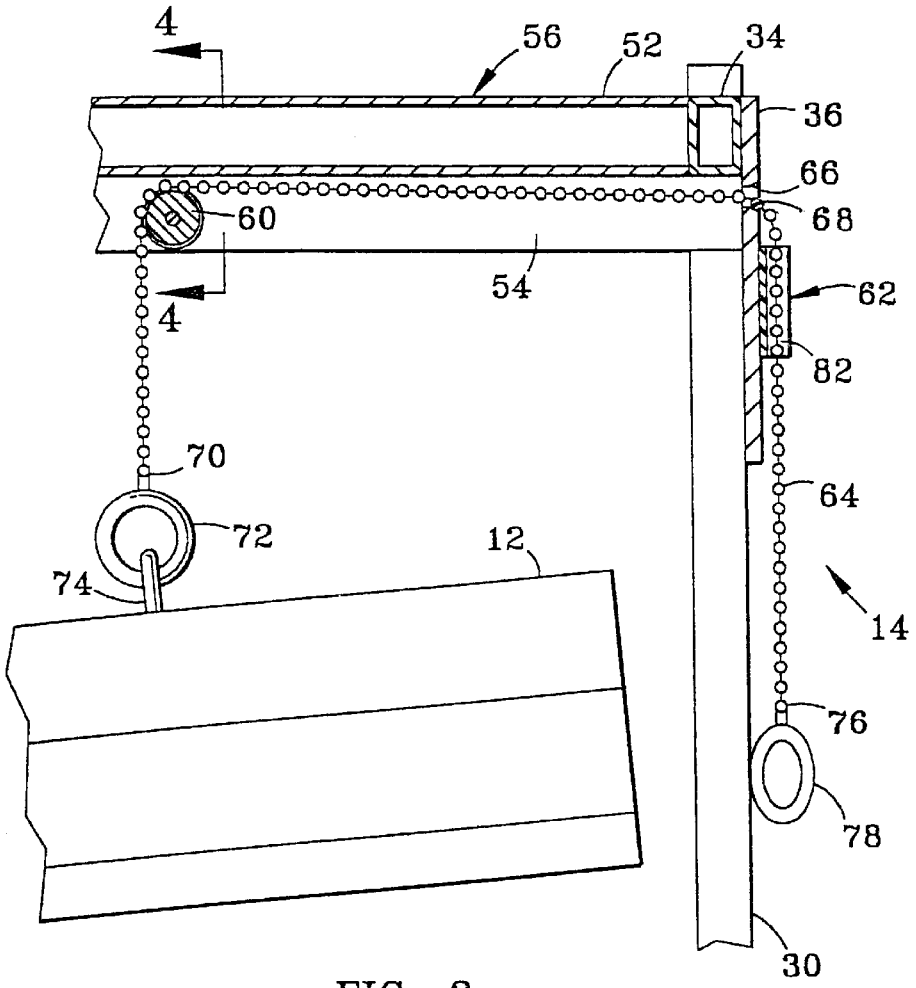
FIG. 3
FIG. 4
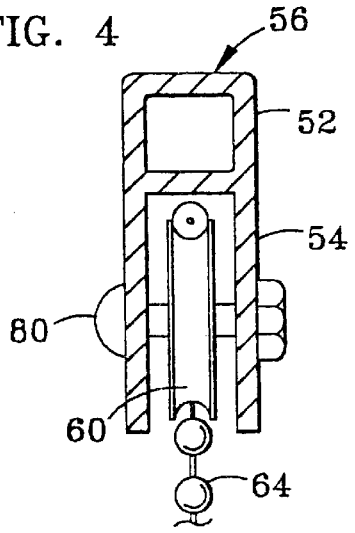

LIGHT STAND HAVING A FIXTURE HEIGHT ADJUSTMENT MECHANISM

CROSS REFERENCE TO RELATED APPLICATION

This application claims the benefit of priority of U.S. Provisional Application Ser. No. 60/171,124 , filed Dec. 16, 1999, entitled "Light Stand."

FIELD OF INVENTION

The present invention relates generally to supports for light fixtures. More particularly, the present invention is directed to a light stand having a fixture height adjustment mechanism.

BACKGROUND OF THE INVENTION

It is often desirable to adjust the height of a light fixture to suit a particular application. For example, growers of plants often use artificial light to provide the plants with the light energy necessary for the plants to grow. Typically, the sources of artificial light are fluorescent fixtures that are positioned above the plants to radiate their light energy on plants located below the fixtures. To increase the flexibility of growing plants under artificial light, light stands have been developed to support one or more fluorescent light fixtures above one or more growing regions located below the fluorescent light fixture(s).

Light stands for growing plants under artificial light generally may be characterized as either fixed or adjustable. A conventional fixed light stand comprises two vertical supports spaced from one another and joined at their upper ends by a horizontal member. The lower end of each vertical support includes a base for stabilizing the light stand in a plane perpendicular to the horizontal member. A fluorescent light fixture is attached to the horizontal member at a fixed height above a growing region located below the light fixture. A drawback of fixed light stands is that they do not provide a user with the flexibility of adjusting the height of the light fixture above a growing region below the fixture.

A conventional adjustable light stand comprises two vertical support spaced from one another. An elongate fluorescent light fixture extends between the two vertical supports and is attached at each of its ends to a corresponding one of the vertical supports by a slidable connection that allows the light fixture to move vertically relative to each of the vertical supports. Each slidable connection includes a locking mechanism, such as a screw clamp, that allows each end of the light fixture to be secured to the corresponding vertical support at a desired height above a growing region located below the light fixture. Each vertical support includes a base for stabilizing the vertical support in a vertical plane perpendicular to the fluorescent light fixture.

A drawback of such an adjustable light stand is that it can be awkward and difficult for a sole user to adjust the height of the light fixture. For a sole user to adjust the height of the light fixture, the user usually adjusts the height at one end of the light fixture at a time. This is so because the distance between the vertical supports is typically on the order of 50-inches or more to accommodate a standard 48-inch fluorescent light fixture. Proceeding one end at a time, however, can cause the slidable connections to bind, particularly if the user attempts to raise one end of the light fixture to a height substantially greater than the other end.

SUMMARY OF THE INVENTION

In one aspect, the present invention is directed to a stand for an elongate light fixture having at least a first attachment element. The stand comprises at least a first generally vertical support having an upper end and a lower end spaced from the upper end, and a first generally horizontal member having a first end attached to the first vertical support adjacent the upper end, the horizontal member for suspending the light fixture therebelow. The stand further comprises at least a first height adjustment mechanism that includes a guide attached to said first horizontal member and having an arcuate surface a located above the light fixture when the light fixture is supported by the stand. The height adjustment mechanism further includes an elongate flexible member having an end, a first portion and a second portion spaced from the first portion. The end of the elongate flexible member is adapted for engaging the first attachment element of the light fixture and the first portion engages the arcuate surface of the guide. A securing device is attached to the vertical support and located between the upper and lower ends of the vertical support. The securing device is for releasably engaging the second portion of the flexible member.

In another aspect, the present invention is directed to a method of adjusting the height of a light fixture supported by a light stand. The light stand has at least a first substantially vertical support, a substantially horizontal member attached to the first vertical support, at least a first guide attached to the horizontal member, at least a first securing device attached to the first substantially vertical support and at least a first elongate flexible member attached to the light fixture at a first location and extending over and in contact with the first guide. The method includes adjusting a length of the first elongate flexible member played out from the first guide to position at least a first portion of the light fixture at a first desired height. The first elongate flexible member is then engaged with the first securing device to secure the first portion of the light fixture at the first desired height.

BRIEF DESCRIPTION OF THE DRAWINGS

For the purposes of illustrating the present invention, the drawings show a form of the invention that is presently preferred. However, it should be understood that this invention is not limited to the precise arrangements and instrumentalities shown in the drawings.

FIG. 3 is an enlarge partial view showing the height adjustment mechanism of the light stand shown in FIG. 1.

FIG. 4 is a cross-sectional view of the light stand of FIG. 1 as taken along line 4-4 of FIG. 3.

DETAILED DESCRIPTION OF THE INVENTION

Figure 1:
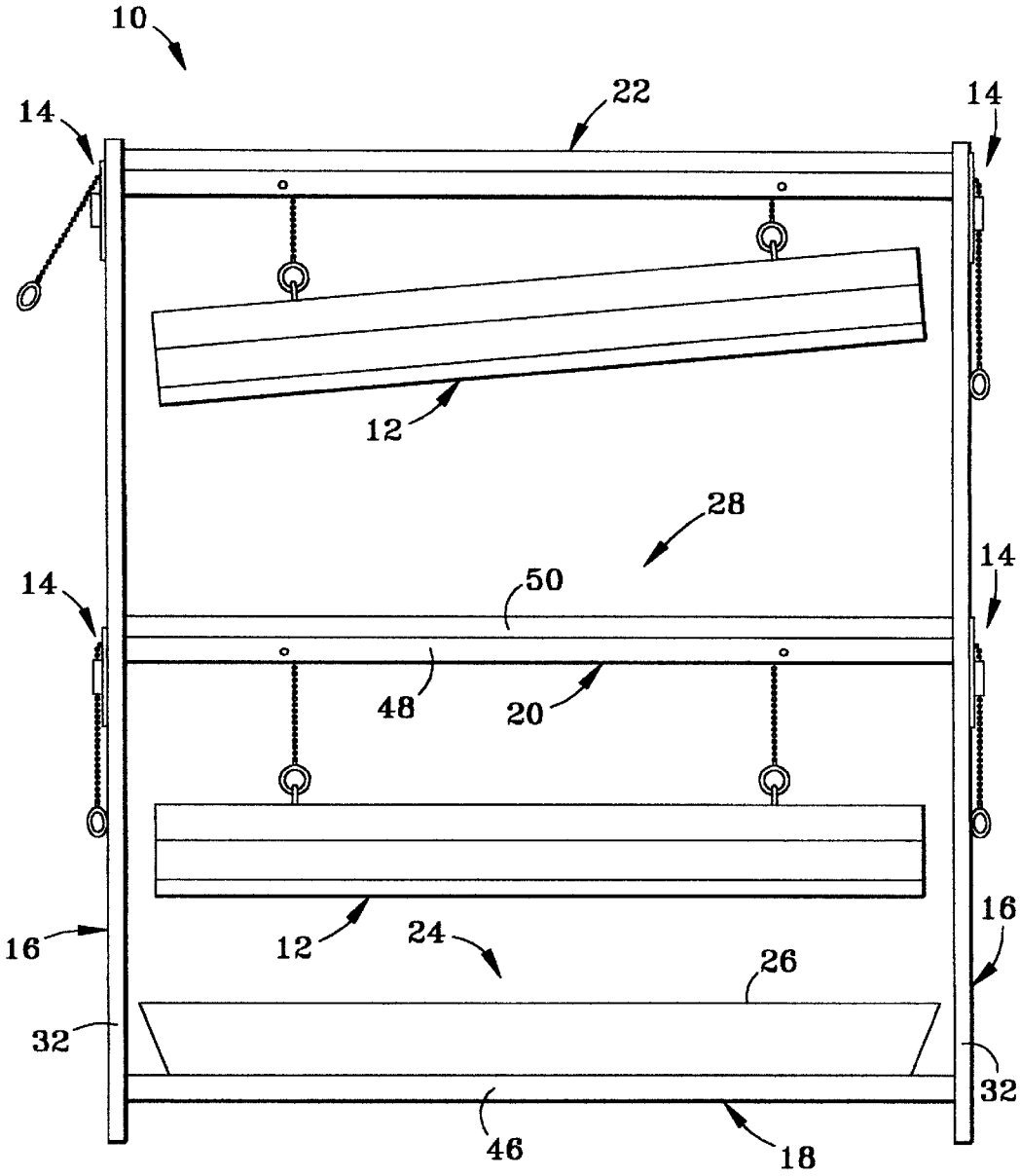
FIG. 1 is a front elevational view illustrating a light stand in accordance with the present invention.
Figure 2:
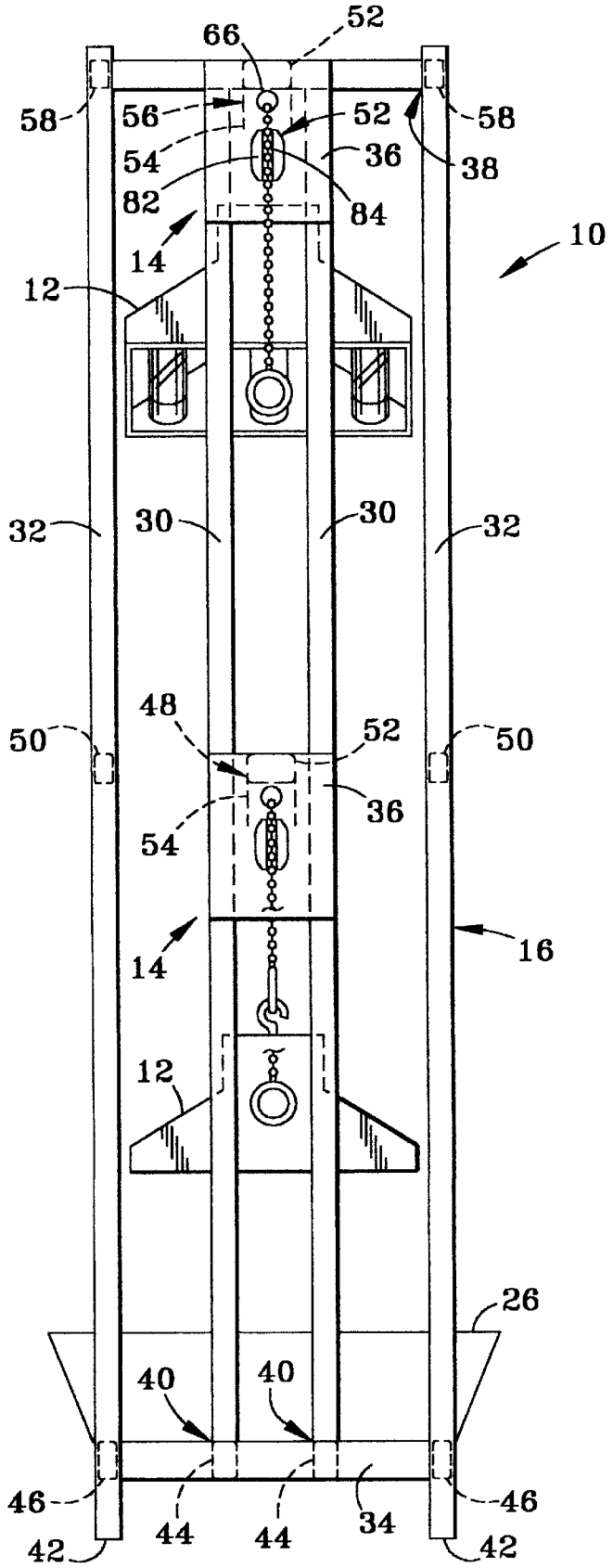
FIG. 2 is a side elevational view of the light stand shown in FIG. 1.

Referring now to the drawings, wherein like numerals indicate like elements throughout the various figures, FIGS. 1 and 2 show in accordance with the present invention a light stand, which is denoted generally by the numeral 10. Light stand 10 supports a pair of elongate light fixtures 12 and allows a user (not shown) to easily adjust the height of each light fixture via a pair of height adjustment mechanisms 14. In a preferred embodiment, light stand 10 is particularly suited for growing plants (not shown) under artificial lighting conditions. Accordingly, light fixture 10 is preferably a fluorescent light fixture, such as a standard 48-inch fixture as shown in the drawings. However, one skilled in the art will readily appreciate that light stand 10 may be used for a variety of applications including illuminating a workspace, illuminating of an exhibit and infrared warming of prepared foods, among others. Thus, light fixture 10 may be another type of elongate fixture, such as a fixture containg a plurality of conventional incandescent lamps, halogen lamps, infrared lamps, ultraviolet lamps and the like.

Light stand 10 comprises two vertical supports 16 and three support levels 18, 20, 22. Support level 18 provides a first growing region 24 and is intended to supporting plants (not shown) and associated items, such as tray 26. Support level 20 supports lower light fixture 12 and provides a second growing region 28 for support more plants and associated items. Support level 22 supports upper light fixture 12. Although light stand 10 is shown comprising two levels of light fixtures 12 and two growing regions 24, 28, the light stand may be provided with any number of levels of light fixtures and growing regions desired.

Each vertical support 16 preferably includes two inner vertical members 30, two outer vertical members 32, upper and lower horizontal tie members 34 and two plates 36. Each of members 30, 32, 34 and plates 36 is preferably made of metal. However, each may also be made of other materials, such as plastic and wood. In addition, vertical members 30, 32 and tie members 36 are preferably formed using an extrusion process.

Upper and lower horizontal tie members 34 are attached at their ends to outer vertical members 32 in a manner that provides connections 38 resistant to rotation to provide stability to each vertical support 16 in the plane of the respective vertical support. Accordingly, connections 38 may be made using various fastening means such as mechanical fasteners, welding and adhesive bonding, among others. Inner vertical members 30 are similarly connected via connections 40 at their ends to upper and lower horizontal tie members 34. Plates 36 are attached to inner vertical members 30, e.g., by mechanical fasteners, welding or adhesive bonding. Optionally, upper plate 30 may be secured to upper horizontal tie member 34.

Lower ends 42 of outer vertical support members 32 may be provided with feet or wheels (not shown) as desired, e.g., to make stand 10 less prone to marring the support surface below the stand or to enhance the mobility of the stand. Although vertical supports 16 are shown as comprising a variety of vertical and horizontal members 30, 32, 34, the vertical supports may includes more or fewer components as desired to suits a particular design. For example, each vertical support 16 may comprise a single tubular member and a base (not shown), which provides each support with the necessary stability. Such single tubular member would be provided in place of the two members 30 and two members 32. One skilled in the art will appreciate the other arrangements of vertical supports 16 that may be provided to a light stand made in accordance with the present invention.

Support level 18 includes two inner members 44 and two outer horizontal members 46, each of which is connected at its respective ends to a corresponding one of vertical supports 16 by a connection that generally resists rotation to provide light stand 10 with stability in a plane perpendicular to the vertical supports. Preferably, horizontal members 44, 46 are extruded metal tubes, but may be other shapes, formed in a manner other than extrusion and made of materials other than metal in a manner similar to vertical members 30, 32 and horizontal tie members 34 of vertical supports 16. The primary purpose of inner and outer horizontal members 44, 46 is to provide support for plants and associated items, such as tray 26, located in first growing region 24.

Support level 20 includes one inner horizontal member 48 and two outer horizontal members 50. Inner horizontal member 48 is attached at each of ends to a corresponding plate 36, e.g., by mechanical fastening, welding or adhesive bonding. Preferably, inner horizontal member 48 is a metal extrusion generally forming a rectangular tube portion 52 and a downwardly-turned U-shaped portion 54. However, one skilled in the art will appreciate the variety of shapes, forming methods and material that may be used for inner horizontal member 48 Inner horizontal member 48 is generally provided to support lower light fixture 12.

Outer horizontal members 50 are preferably rectangular extruded metal tubes, but may be other shapes, formed in a manner other than extrusion and made of materials other than metal similar to vertical members 30, 32 and horizontal tie members 34 of vertical supports 16. Outer horizontal members 50 are preferably attached at each of their ends to a corresponding one of vertical supports 16 by a connection that generally resists rotation to provide light stand 10 with stability in a plane perpendicular to the vertical supports 16. The primary purpose of outer horizontal members 50 is to provide support for plants and associated items located in second growing region 28.

Support level 22 includes one inner horizontal member 56 and two outer horizontal members 58. Inner horizontal member 56 is attached at each of ends to a corresponding plate 36, e.g., by mechanical fastening, welding or adhesive bonding. Preferably, inner horizontal member 56 is a metal extrusion generally forming a rectangular tube portion 52 and a downwardly-turned U-shaped portion 54 similar to inner horizontal member 44 of support level 20. However, one skilled in the art will appreciate the variety of shapes, forming methods and material that may be used for inner horizontal member. Inner horizontal member 56 is generally provided to support upper light fixture 12.

Outer horizontal members 58 are preferably rectangular extruded metal tubes, but may be other shapes, formed in a manner other than extrusion and made of materials other than metal similar to vertical members 30, 32 and horizontal tie members 34 of vertical supports 16. Outer horizontal members 58 are preferably attached at each of their ends to a corresponding one of vertical supports 16 by a connection that generally resists rotation to provide light stand 10 with stability in a plane perpendicular to the vertical supports. The primary purpose of outer horizontal support members 58 is to provide stability to light stand 10.

FIGS. 3 and 4 particularly show one of the height adjustment mechanisms 14 of light stand 10. Each of the height adjustment mechanisms 14 not illustrated in FIGS. 3 and 4 is similar to the height adjustment mechanism shown in these figures. Height adjustment mechanism 14 comprises a guide 60, a securing device 62 and an elongate flexible member 64. As described below in detail, each height adjustment mechanism 14 allows a user to easily adjust the height of one end of light fixtures 12 to a desired height relative to a corresponding one of growing regions 24, 26 (see FIG. 1) located below the light fixture by changing the length of flexible member 64 played out from securing device 62, which secures the flexible member, and thus light fixture 12, in the desired position.

Flexible member 64 extends over guide 60 and through an aperture 66 in plate 36, where it is captured by securing device 62. Plate 36 may include an arcuate surface 68 at aperture 66 to aid the transition of flexible member 64 from substantially horizontal to substantially vertical and increase the ease of operating height adjustment mechanism 14. A sheave (not shown) similar to the sheave described below in connection with guide 60, a bushing or other device may be provided in lieu of arcuate surface 68 to increase the ease of operating height adjustment mechanism 14.

End 70 of elongate flexible member 64 includes a connector, such as ring 72, that allows the flexible member to be secured to an attachment element 74 on light fixture 12. Advantageously, ring 72 provides the beneficial feature of preventing flexible member 64 from disengaging guide 60 when light fixture 12 is not present. Opposite end 76 of elongate flexible member 64 includes a grasping member, such as ring 78, a handle or the like, that provides a user a convenient means for grasping the flexible member. Advantageously, ring 78 provides the beneficial feature of preventing flexible member 64 from disengaging aperture 66 and light fixture 12 from hitting a plant or other item located below the light fixture if a user releases the flexible member when it is not properly engaged with securing device 62.

Elongate flexible member 64 may be a ball-type chain or other elongate flexible member, such as a cord or a link-type chain, may be provided. In addition, elongate flexible member 64 may be made of any suitable material, such as metal, plastic or natural or synthetic fibers. Flexible member 64 may be provided in any length desired to suit a particular application. For example, the length of flexible member 64 extending downward beyond securing device 62 may need to be particularly long depending upon the ability of a user to conveniently reach ring 78.

Guide 60 is located within channel defined by U-shaped portion 54 of each inner horizontal support member 56 and is rotably secured to the inner horizontal support member, e.g., by fastener 80, which extends through the U-shaped portion. Guide 60 is provided to guide elongate flexible member 64 and gradually change the direction of the flexible member from substantially horizontal so that the flexible member passes through aperture 66 to vertical so that the flexible member does not impart a horizontal force to light fixture 12, and to reduce the amount of effort a user must exert when adjusting the height of the light fixture. Therefore, guide 60 is preferably a sheave made of a suitable material, such as metal or plastic, and may include rotational bearings as desired. In an alternative embodiment, guide 60 may comprise a fixed member having an appropriately curved smooth surface to provide the function of guiding the chain and gradually changing its direction.

Referring now to FIGS. 2 and 3, securing device 62 is attached to plate 36, e.g., by mechanical fasteners, welding or adhesive bonding, and is located downwardly adjacent aperture 66. However, securing device 62 may be located more remote from aperture 66, if desired. In a preferred embodiment, securing device 62 is a jam cleat made of plastic and comprising two grips 82 spaced from one another to define a vertical groove 84. When flexible member 64 is not engaged with securing device 62, the minimum width of groove 84 is less than the diameter of the flexible member. To secure flexible member 64 in securing device 62, a user forces the flexible member into groove 84, causing grips 82 to displace away from one another due to the flexibility of the plastic from which the securing device is preferably made. One skilled in the art will appreciate that groove 84 may have any one of a variety of shapes, such as tapered end to end, hourglass, V-shaped along its length, a combination of tapered and V-shaped, among others. The opposing walls of groove 84 may optionally be provided with outstanding ribs or other structures that further enhance the grip-ability of securing device 62 with respect to flexible member 64.

In alternative embodiments of light stand 12 of the present invention, securing devices 62 may be other than a jam cleat. For example, securing device 62 may comprise a pair of first and second members, wherein at least the first member is pivotable about an eccentric axis and biased toward the second member. When elongate flexible member 64 is engaged between the first and second members, the tension on the flexible member and interaction of the flexible member with the first and second members tend to rotate the first member toward the second member to increase the clamping force applied by the first and second members on the flexible member. One or both first and second members may include a feature, such as teeth or soft rubber, to enhance the interaction between them and the flexible member. In another alternative embodiment, securing device 62 may be a horned cleat around which chain may be wrapped. In yet another alternative embodiment for use when elongate flexible member is a ball-type chain, securing device 62 may comprise a slotted member having a slot narrower than the diameter of the diameter of the balls of the chain. Shoulders on the lower side of the member would be engagable with a portion of the upper surface of one of balls of chain. Although several embodiments of securing device 62 have been described with particularity, these embodiment are not intended to be exhaustive of the variety of securing devices that may be provided to light stand 10 within the scope of the present invention. One skilled in the art will understand the variety of securing devices that may be used to secure elongate flexible member 64 in its desired position.

To adjust the height of one end of light fixture 12, a user operates height adjustment mechanisms 14 as follows. First, a user grasps ring 78 pulling it in a direction generally outward and away from vertical support 16. In this manner, elongate flexible member 64 is disengaged from securing device 62 (see FIG. 1). While pulling ring 78 away from vertical member 16, user should also apply tension to flexible member 64 because when the flexible member disengages securing device 62, the user will have to support a portion of the weight of light fixture 12. Once the user has disengaged flexible member 64 from securing device 62, the user may move light fixture 12 to a desired height by either pulling on ring 78 to shorten the amount of the flexible member played out from guide 60 or allowing the weight of the light fixture 12 impart the pull necessary to increase the amount of the flexible member played out from the guide. After the user has positioned the end of light fixture 12 at the desired height, the user engages flexible member 64 with securing device 62 by inserting the flexible member into groove 84 to an extent that the flexible member becomes wedged between grips 82. After securing flexible member 64 in securing device 62, the user may proceed to adjust the height of the opposite end of light fixture 12 or adjust the height of the other light fixture as desired.

One skilled in the art will recognize the many variations of light stands 10 that may be made in accordance with the present invention. For example, a light stand of the present invention may have only one vertical support and one or more fixture-supporting horizontal members cantilevering from the vertical support. In this embodiment, each horizontal member may include a pair height adjustment mechanisms, similar to height adjustment mechanism 14, that may be operated together or individually from only one end of the horizontal member, such as the end adjacent the vertical support, or individually from opposite ends of the horizontal member. In another embodiment, light stand 10 may have only a sole height adjustment mechanism 14. For example, a light stand having a sole height adjustment mechanism 14 for an elongate light fixture, such as light fixture 12, may have the height adjustment mechanism centered over the center of gravity of the light stand. Any horizontal movement, i.e., rotation or translation, of light fixture could be limited by providing one or both ends of the light fixture with a vertical guide.

While the present invention has been described in connection with a preferred embodiment, it will be understood that it is not so limited. On the contrary, it is intended to cover all alternatives, modifications and equivalents as may be included within the spirit and scope of the invention as defined in the appended claims.

What is claimed is:

1. A stand for an elongate light fixture having at least a first attachment element, comprising:

a. at least a first generally vertical support having an upper end and a lower end spaced from said upper end;

b. a first generally horizontal member having a first end attached to said first vertical support adjacent said upper end, said horizontal member for suspending the light fixture therebelow; and c. at least a first height adjustment mechanism, comprising:

i. a guide attached to said first horizontal member and having an arcuate surface located above the light fixture when the light fixture is supported by the stand;

ii. an elongate flexible member having an end, a first portion and a second portion spaced from said first portion, said end of said elongate flexible member adapted for engaging the first attachment element of the light fixture, said first portion engaging said arcuate surface of said guide; and iii. a securing device attached to said vertical support and located between said upper and lower ends of said vertical support, said securing device for releasably engaging said second portion of said flexible member.

2. A stand according to claim 1, wherein said guide comprises a sheave.

3. A stand according to claim 1, wherein said elongate flexible member comprises a ball-type chain.

4. A stand according to claim 1, wherein said elongate flexible member further comprises a grasping device proximate said second portion, said grasping device for permitting a user to conveniently grasp said elongate flexible device.

5. A stand according to claim 4, wherein said grasping device comprises a ring.

6. A stand according to claim 1, wherein said securing device is a jam cleat.

7. A stand according to claim 1, wherein the light fixture further comprises a second attachment element spaced from the first attachment element and the stand further comprising a second height adjustment mechanism for attaching to the second attachment element.

8. A stand according to claim 1, further comprising a second vertical support and wherein said horizontal member has a second end attached to said second vertical support.

9. A stand according to claim 8, wherein the light fixture further comprises a second attachment element spaced from the first attachment element, the stand further comprising a second height adjustment mechanism for attaching to the second attachment element.

10. A light stand system, comprising:

a. an elongate light fixture having first and second attachment elements spaced from one another; and b. a light stand supporting said light fixture and including at least a first height adjustment mechanism comprising:

i. a guide having an arcuate surface located above said light fixture;

ii. an elongate flexible member having an end, a first portion and a second portion, spaced from said first portion, said first end of said elongate flexible member adapted for engaging at least one of the first and second attachment elements of the light fixture said first portion engaging said arcuate surface of said guide; and iii. a securing device fixedly attached to said light stand, said securing device for releasably engagig said second portion of said flexible member.

11. A system according to claim 10, further including a second height adjustment mechanism attached to said second attachment element of said light fixture.

12. A system according to claim 10, wherein said second height adjustment mechanism comprises:

a. a guide attached to light stand and having an arcuate surface located above said light fixture;

b. an elongate flexible member having an end, a first portion and a second portion spaced from said first portion, said first end of said elongate flexible member adapted for engaging at least one of the first and second attachment elements of the light fixture, said first portion engaging said arcuate surface of said guide; and c. a securing device attached to said light stand, said securing device for releasably engaging said second portion of said flexible member.

13. A system according to claim 10, wherein said light stand comprise first and second vertical supports spaced from one another and an elongate horizontal member having a first end and a second end, said horizontal member attached at said first end to said first vertical support and at said second end to said second vertical support.

14. A system according to claim 13, wherein said guide is attached to said horizontal member and said securing device is attached to said first vertical support.

15. A system according to claim 13, further comprising a second height adjustment mechanism comprising:

a. a guide attached to light stand and having an arcuate surface located above said light fixture;

b. an elongate flexible member having an end, a first portion and a second portion spaced from said first portion, said first end of said elongate flexible member adapted for engaging at least one of the first and second attachment elements of the light fixture, said first portion engaging said arcuate surface of said guide; and c. a securing device attached to said light stand, said securing device for releasably engaging said second portion of said flexible member.

16. A system according to claim 15, wherein each of said guides of said first and second height adjustment mechanisms is attached to said horizontal member, said securing device of said first height adjustment mechanism is attached to said first vertical support and said securing device of said second height adjustment mechanism is attached to said second vertical support.

17. A method of adjusting the height of a light fixture supported by a light stand having at least a first substantially vertical support a substantially horizontal member attached to the first vertical support, at least a first guide attached to the horizontal member, at least a first securing device attached to the first substantially vertical support and at least a first elongate flexible member attached to the light fixture at a first location and extending over and in contact with the first guide, the method comprising the steps of:

a. adjusting a length of the first elongate flexible member played out from the first guide to position at least a first portion of the light fixture at a first desired height; and b. releasably engaging the first elongate flexible member with the first securing device to secure said first portion of the light fixture at said first desired height.

18. A method according to claim 17, wherein the light stand further comprises a second substantially vertical support attached to the horizontal member, a second guide attached to the horizontal member, a second securing device attached to the second substantially vertical support and a second elongate flexible member attached to the light fixture at a second location spaced from the first location and extending over and in contact with the second guide, the method further comprising the steps of:

a. adjusting a length of the second elongate flexible member played out from the second guide to position a second portion of the light fixture at a second desired height; and b. engaging the second elongate flexible member with the second securing device to secure said second portion of the light fixture at said second desired height.

* * * * *

UNITED STATES PATENT AND TRADEMARK OFFICE

CERTIFICATE OF CORRECTION

PATENT NO. : 6,450,669 B2
DATED : September 17, 2002
INVENTOR(S) : Buss et al.

It is certified that error appears in the above-identified patent and that said Letters Patent is hereby corrected as shown below:

Column 8,
Line 4, delete "," between the words "portion" and "spaced".
Line 7, insert -- , -- between the words "fixture" and "said".
Line 11, delete "engagig" and insert -- engaging -- therefor.
Line 61, insert -- , -- between the words "support" and "a".

Signed and Sealed this

Sixth Day of July, 2004

JON W. DUDAS
*Acting Director of the United States Patent and Trademark Office*